US010424883B2

(12) United States Patent
Kolb et al.

(10) Patent No.: US 10,424,883 B2
(45) Date of Patent: Sep. 24, 2019

(54) ELECTRICAL PLUG CONNECTION BETWEEN A POWER SOURCE AND AN ELECTRICAL WORK APPARATUS

(71) Applicant: Andreas Stihl AG & Co. KG, Waiblingen (DE)

(72) Inventors: Joachim Kolb, Ludwigsburg (DE); Alexander Nordmann, Stuttgart (DE); Markus Maier, Leutenbach (DE); Jochen Luz, Waiblingen (DE); Daniel Bahner, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 15/884,220

(22) Filed: Jan. 30, 2018

(65) Prior Publication Data

US 2018/0219337 A1 Aug. 2, 2018

(30) Foreign Application Priority Data

Jan. 30, 2017 (DE) ..... 10 2017 000 996

(51) Int. Cl.

| | |
|---|---|
| ***H01R 24/38*** | (2011.01) |
| ***H01R 13/04*** | (2006.01) |
| ***H01R 13/11*** | (2006.01) |
| ***H01R 13/20*** | (2006.01) |
| ***H01R 13/627*** | (2006.01) |

(Continued)

(52) U.S. Cl.

CPC ..... *H01R 24/38* (2013.01); *H01R 13/04* (2013.01); *H01R 13/112* (2013.01); *H01R 13/20* (2013.01); *H01R 13/504* (2013.01); *H01R 13/627* (2013.01); *H01R 2103/00* (2013.01)

(58) Field of Classification Search

CPC ..... H01R 13/04; H01R 13/112; H01R 13/15; H01R 13/18; H01R 13/187; H01R 13/20; H01R 13/504; H01R 13/627; H01R 13/6273; H01R 13/6275; H01R 13/6277; H01R 24/38

See application file for complete search history.

(56) References Cited

U.S. PATENT DOCUMENTS 5,941,726 A * 8/1999 Koegel ..... H01R 13/6275 439/354

6,855,003 B1 * 2/2005 Wyant ..... H01R 13/2421 439/108

(Continued)

*Primary Examiner* — Edwin A. Leon
*Assistant Examiner* — Oscar C Jimenez
(74) *Attorney, Agent, or Firm* — Walter Ottesen, P.A.

(57) ABSTRACT

An electrical plug connection is for electrically connecting a power source in a releasable manner to an electrical work apparatus. The plug connection includes at least one first electrical line for the purpose of transmitting electrical power and at least one second electrical line for the purpose of transmitting signals. The plug connection includes a plug with a plug body and one or more first plug contacts and a plug socket with first contact sockets, wherein the plug contacts of the first electrical line are arranged within the plug body. The plug contact of the second electrical line is in the form of an external contact in the region of an outer contour of the plug body, wherein a mating contact of the plug socket is associated with the external contact of the plug body. The external contact and the mating contact form a latching connection.

17 Claims, 14 Drawing Sheets

(51) Int. Cl.
*H01R 103/00* (2006.01)
*H01R 13/504* (2006.01)

(56) References Cited

U.S. PATENT DOCUMENTS

| | | | | |
|---|---|---|---|---|
| 7,001,201 | B1 * | 2/2006 | Peng | H01R 13/6275 439/358 |
| 7,867,010 | B1 * | 1/2011 | Ting | H01R 13/6275 439/353 |
| 9,409,536 | B2 * | 8/2016 | Gunreben | B60R 21/16 |
| 2003/0176087 | A1 * | 9/2003 | Erez | H01R 13/4538 439/108 |
| 2007/0032102 | A1 | 2/2007 | Tang et al. | |
| 2013/0065409 | A1 * | 3/2013 | Lin | H01R 24/86 439/92 |
| 2015/0056841 | A1 * | 2/2015 | Siwek | H01R 13/6273 439/352 |
| 2015/0072562 | A1 | 3/2015 | Little et al. | |

* cited by examiner

ELECTRICAL PLUG CONNECTION BETWEEN A POWER SOURCE AND AN ELECTRICAL WORK APPARATUS

CROSS REFERENCE TO RELATED APPLICATION

This application claims priority of German patent application no. 10 2017 000 996.1, filed Jan. 30, 2017, the entire content of which is incorporated herein by reference.

FIELD OF THE INVENTION

The invention relates to an electrical plug connection for electrically connecting a power source, preferably a rechargeable battery pack, in a releasable manner to an electrical work apparatus, wherein the plug connection includes at least one first electrical line for the purpose of transmitting an electrical power and at least one second electrical line for the purpose of transmitting signals. The plug connection has a plug with a plug body and one or more first plug contacts and also a plug socket with first contact sockets, wherein the plug contacts of the first electrical line are arranged within the plug body.

BACKGROUND OF THE INVENTION

Signal lines which are to be provided separately from the electrical lines which transmit power are required for the purpose of communication between the electronics system of a rechargeable battery pack and the motor controller of an electrical work apparatus. Since the electrical lines have to transmit high currents for power transmission, corresponding line cross sections are provided. The number of electrical lines to be connected via a plug connection leads to a considerable physical size. When working with electrical work apparatuses, large, bulky plug connections are usually detrimental and hinder the work.

SUMMARY OF THE INVENTION

It is an object of the invention to provide an electrical plug connection for connecting a rechargeable battery pack to an electrical work apparatus, which is of small construction, can transmit a high electrical power and is mechanically reliably secured in a simple manner.

The object can, for example, be achieved via an electrical plug connection for releasable electrical connection of a power source to an electric work apparatus. The electrical plug connection includes: a first electrical line configured to transmit electrical power; at least one second electrical line configured to transmit signals; a plug including a plug body having an outer contour; a first plug contact; a plug socket having a first contact socket; the first plug contact being associated with the first electrical line and being arranged within the plug body; the second electrical line having a second plug contact; the second plug contact being configured as an external contact in the region of the outer contour; said plug socket having a mating contact associated with the external contact of the plug body; and, the mating contact and the external contact being configured to form a latching connection.

The plug contact between the second electrical line is in the form of an external contact in the region of an external contour of the plug body. As a result, the electrical contacts which are required for signal transmission can be shifted outward from the center of the plug connection, as a result of which the diameter of the plug connection can be kept small. A mating contact on the plug socket is associated with the external contact of the plug body, wherein the configuration is such that the external contact and the mating contact form a mechanical latching connection. Therefore, insertion of the plug into the plug socket of the electrical plug connection according to an aspect of the invention results not only in secure electrical contact-connection with pre-specified operator control forces, but mechanical locking of the plug in the plug socket at the same time.

The external contact is arranged on the outer circumference of the plug body in a simple manner for the purpose of transmitting signals, with the result that the interior of the plug body can be used exclusively for the plug contacts for the electrical power transmission.

The mating contact on the plug socket is advantageously in the form of a spring tongue, as a result of which not only is a secure electrical contact-connection between the external contact and the mating contact ensured but, furthermore, mechanical latching is achieved in a simple manner. To this end, it may be advantageous when the external contact has a latching recess, a latching lug on the mating contact being associated with the latching recess. The latching lug is preferably formed by the free end of the mating contact.

In order to ensure simple insertion of the plug into the plug socket, it is provided to form a ramp in front of the external contact in the insertion direction of the plug body. When the plug is inserted, the latching lug of the mating contact slides on the ramp of the plug body, as a result of which the user receives haptic feedback in respect of the extent to which the plug is inserted on account of the increase in the plugging force which has to be applied. The user can easily establish whether the plug is inserted completely into the plug socket. This feedback is provided to the user by a maximum insertion force being exceeded and/or by a negative force (tensile force) which is generated owing to the configuration of the ramp.

The plug body of the plug advantageously has a plug end, which faces the plug socket, and a connection end which is held in a plug housing. A separating plane is expediently formed between the connection end and the plug housing, wherein the connection end and/or the plug housing have coupling fingers which pass through the separating plane. If, in a particular embodiment of the invention, the interior of the plug body and the interior of the plug housing are filled with an injection-molding compound, a mechanical connection is established between the plug body and the plug housing via the injection-molding compound. Since the coupling fingers protrude into the respective other part via the separating plane, a more secure mechanical connection is achieved between the plug body and the plug housing, the mechanical connection also being able to withstand high pull-out forces.

In a particular embodiment, the plug socket has a circumferential wall which delimits a receptacle for the plug body. The mating contact is situated radially outside the receptacle and protrudes, by way of a free contact end, through a receiving slot in the circumferential wall into the receptacle. The physical size of the plug connection can be kept small owing to the mating contacts being shifted radially outward.

The contact end advantageously has a stop tongue which delimits a protrusion of the contact end, which protrusion protrudes into the receiving space. In this way, the protrusion of the mating contact, which protrusion protrudes into the receiving space, is structurally defined.

In an end view of the plug body, the plug contacts of the first lines which transmit electrical power are situated with an offset in relation to one another. Accordingly, the contact sockets are situated with an offset in relation to one another in an end view of the plug socket. Owing to this offset arrangement of the plug contacts and, respectively, of the contact sockets, space is created in the connection region, this space providing a variety of possible ways of connecting the electrical lines to the plug and, respectively, to the plug socket.

The plug contacts are advantageously in the form of contact tongues which interact with contact sockets which are in the form of contact terminals.

In an advantageous embodiment of the invention, the mating contact of the plug socket has a contact region for making electrical contact with the external contact. An opening is advantageously formed in the contact region of the mating contact, as a result of which the electrical contact-connection can be improved.

The contact region advantageously has a highest elevation. The opening determines, by way of its opening edge, an opening area which is advantageously situated at a vertical distance below the highest elevation. When the highest elevation bears against a bearing surface, the opening area of the opening is situated at a distance from the bearing surface. It is advantageously provided that the opening width of the opening is wider than the width of the external contact. When contact is made, the external contact is situated within the opening area in plan view of the opening. The highest elevations of the contact surface, which highest elevations still exist next to the opening, are situated next to the external contact. There is an overlap between the mating contact and the external contact in side view of the external contact.

The external contact has a main body with two longitudinal edges. Since the width of the external contact, which width is measured between the longitudinal edges, is smaller than the opening width of the opening, the longitudinal edges come to bear against an opening edge of the opening at at least one bearing point so as to make electrical contact. In an advantageous embodiment, a bearing point which is at the front in the insertion direction and a bearing point which is at the rear in the insertion direction are provided on each longitudinal edge. Therefore, a total of four active bearing points can be produced, as a result of which good electrical contact-connection with interference-free signal transmission is ensured. When the mating contact slides onto the external contact, dirt and other interference particles are reliably removed, this promoting reliable electrical contact-connection.

The geometric configuration of the opening is provided in such a way that an edge section of the opening edge of the opening bears against the external contact so as to make electrical contact. An edge section of the opening edge which is at the front in the insertion direction and an edge section of the opening edge which is at the rear in the insertion direction preferably bear against the external contact. In this way, two edge sections can be used for reliable electrical contact-connection with interference-free signal transmission.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
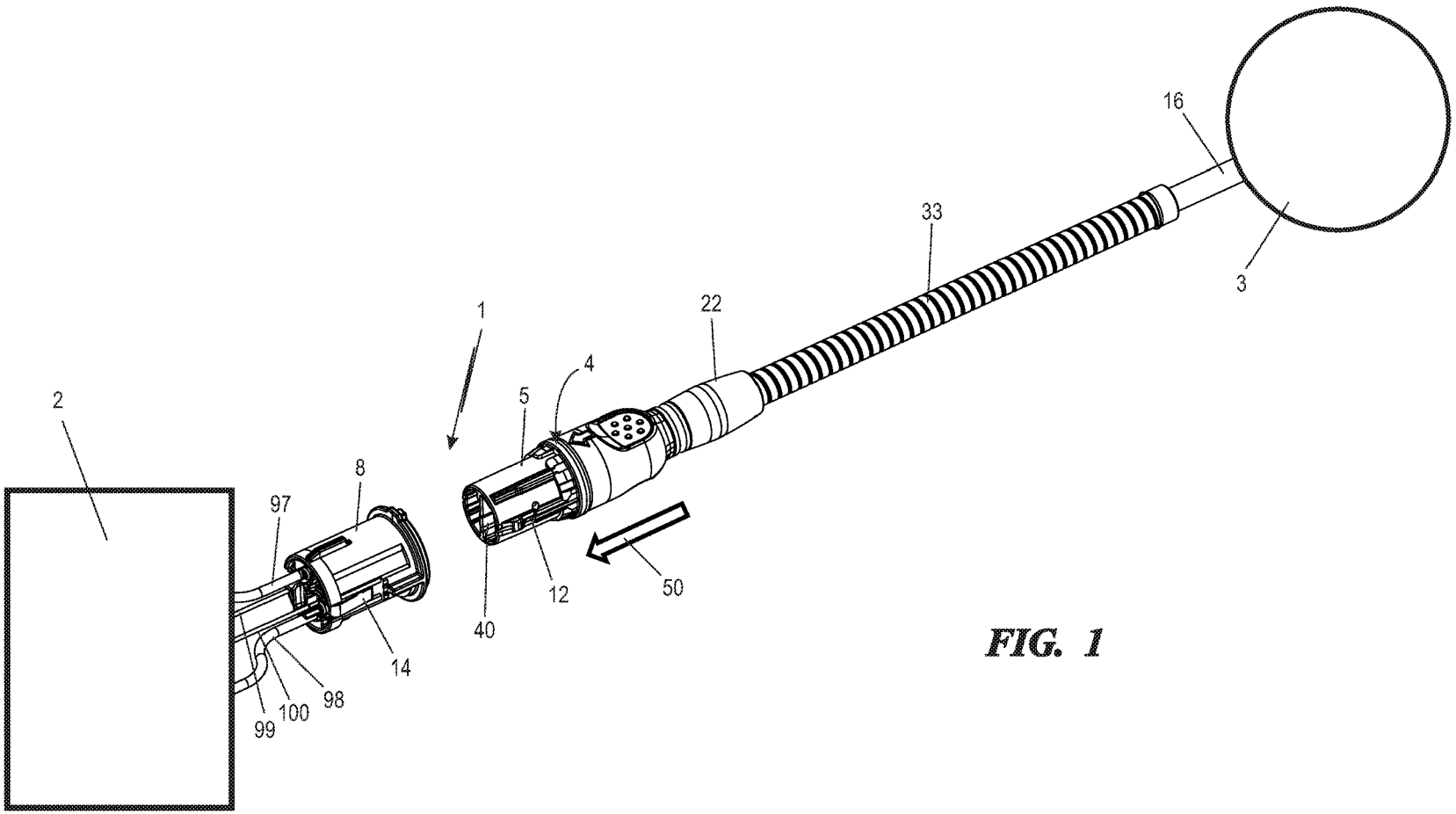
FIG. 1 is a schematic illustration of a plug connection for a connection line between a work apparatus and a rechargeable battery pack.
Figure 2:
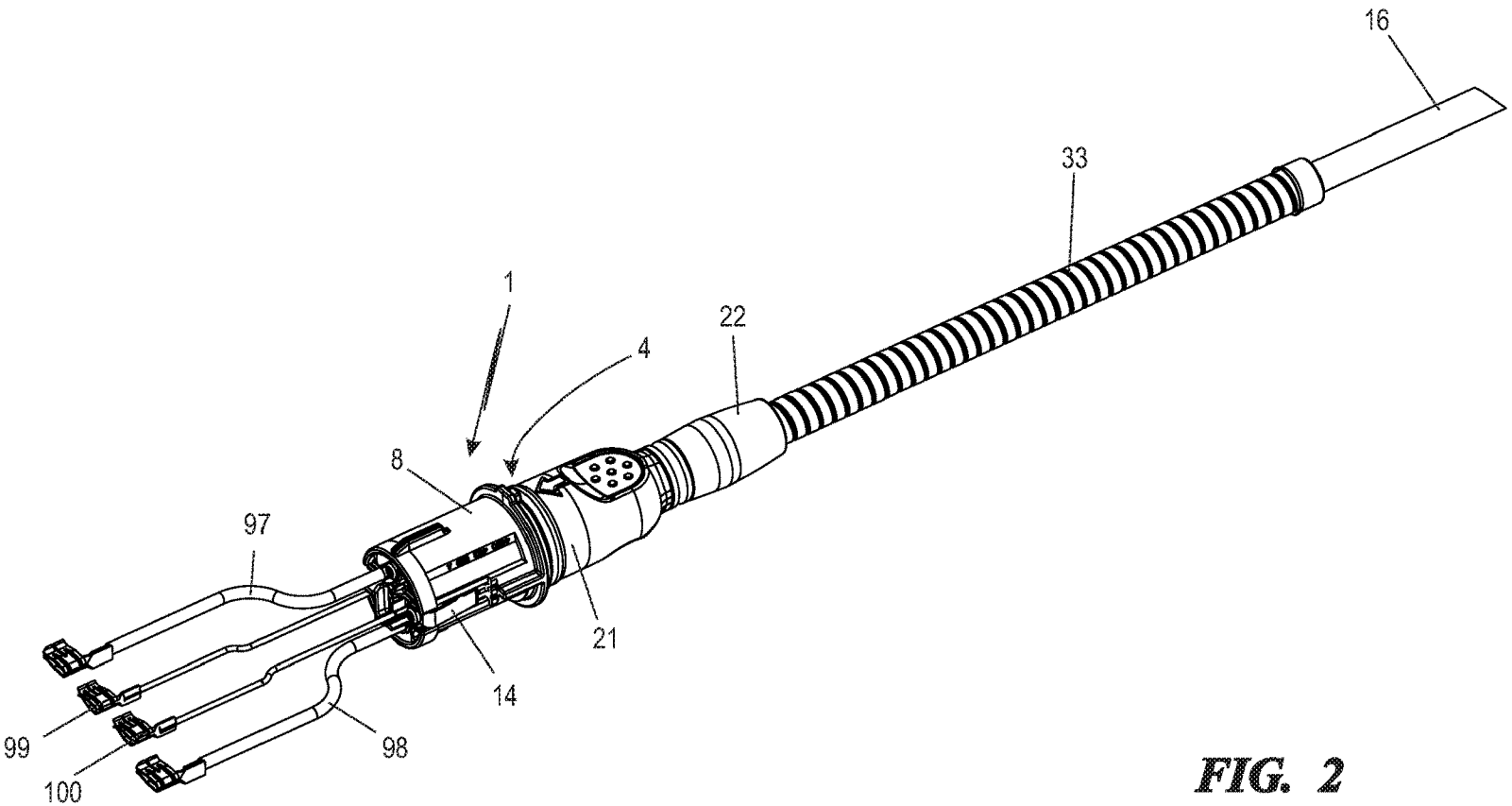
FIG. 2 is an illustration of the connection line according to FIG. 1 with a plug inserted into a plug socket of the plug connection.
Figure 3:
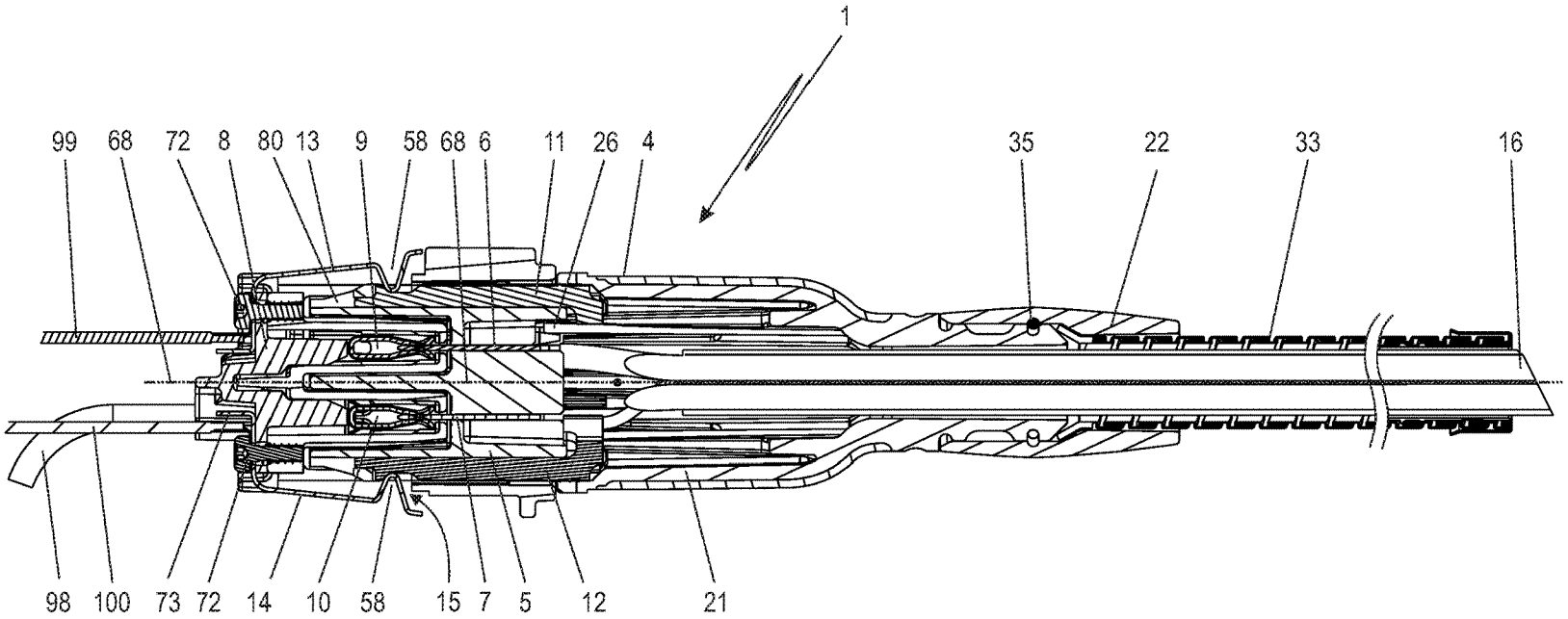
FIG. 3 shows a section through the plug connection according to FIG. 2.
Figure 4:
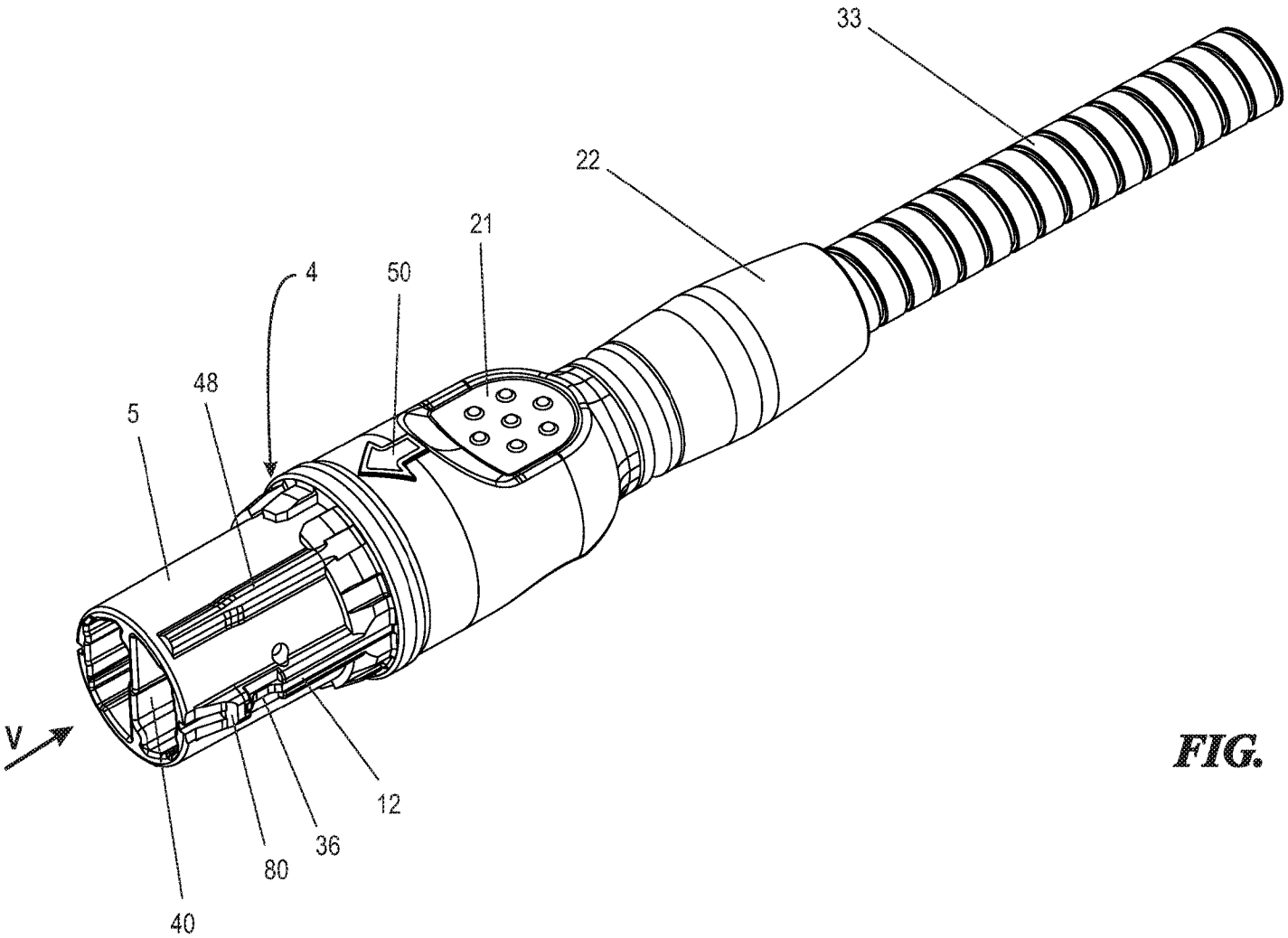
FIG. 4 is a perspective illustration of a plug of a plug connection according to the invention.

FIGS. 1 to 3 illustrate a plug connection 1 which, in the embodiment shown, is provided for electrically connecting a connection line 16 in a releasable manner to a power source, for example a rechargeable battery pack 2. The connection line 16 connects the rechargeable battery pack 2 to an electrical work apparatus 3, wherein a plug connection identical to that between the connection line 16 and the rechargeable battery pack 2 can be provided between the connection line 16 and the work apparatus 3. The plug connection 1 is independent of the application between a rechargeable battery pack 2 and a work apparatus 3 which are specified by way of example, and can also be provided for connecting other electrical connections in a releasable manner. Therefore, it is generally possible to establish any desired connection between a power source and a load using the plug connection according to the invention. The plug connection can also be used for connecting an extension line to an existing connection line 16.

Aspects of the invention are explained below using the example of the plug connection 1 between the connection line 16 and the rechargeable battery pack 2.

The plug connection 1 includes a plug 4 and a plug socket 8. The plug 4 has a plug body 5 and at least one plug contact 6, 7. Two plug contacts 6 and 7 are provided in the embodiment shown according to FIG. 3.

The plug socket 8, in which at least one contact socket 9, 10 for the plug contact 6, 7 of the plug body 5 is provided, is associated with the plug 4. Two contact sockets 9 and 10 are provided in the embodiment shown according to FIG. 3.

The plug body 5 further has at least one external contact 11, 12 in the region of its outer contour. Two external contacts 11, 12 which are arranged such that they are situated, in particular, diametrically opposite one another—with respect to a longitudinal center axis 68 of the plug 4—are provided in the embodiment according to FIG. 3. The relative position of the external contacts 11, 12 in relation to one another is mentioned by way of example; other positions may also be expedient. The number of external contacts can also be freely selected, for example three or more external contacts can also be provided. In the plug socket 8, a mating contact 13, 14 is in each case associated with an external contact 11 and, respectively, 12. In this case, an external contact 11, 12 and the associated mating contact 13, 14 preferably form a latching connection 15 which is illustrated on an enlarged scale in FIGS. 18 and 19.

The connection line 16 is preferably a flexible line, in particular a plastic-sheathed or rubber-sheathed line. In the embodiment shown, the connection line 16 has first electrical lines 17, 18 for the purpose of transmitting an electrical power. Furthermore, two electrical lines 19, 20 which are used for the purpose of transmitting signals are provided. The first electrical lines 17, 18 are connected to first connection lines 97, 98 of the plug socket 8 via the plug connection 1 for the purpose of transmitting electrical power, whereas the second electrical lines 19, 20 are connected to second connection lines 99, 100 of the plug socket 8 via the plug connection 1 for the purpose of transmitting signals. Contact is made with the first connection lines 97, 98 and the second connection lines 99, 100 at the plug socket 8.

The configuration of the plug 4 is shown in FIGS. 4 to 10. The plug substantially includes the plug body 5, a plug housing 21 which is connected to the plug body 5, and an end sleeve 22.

Figures 5, 6:
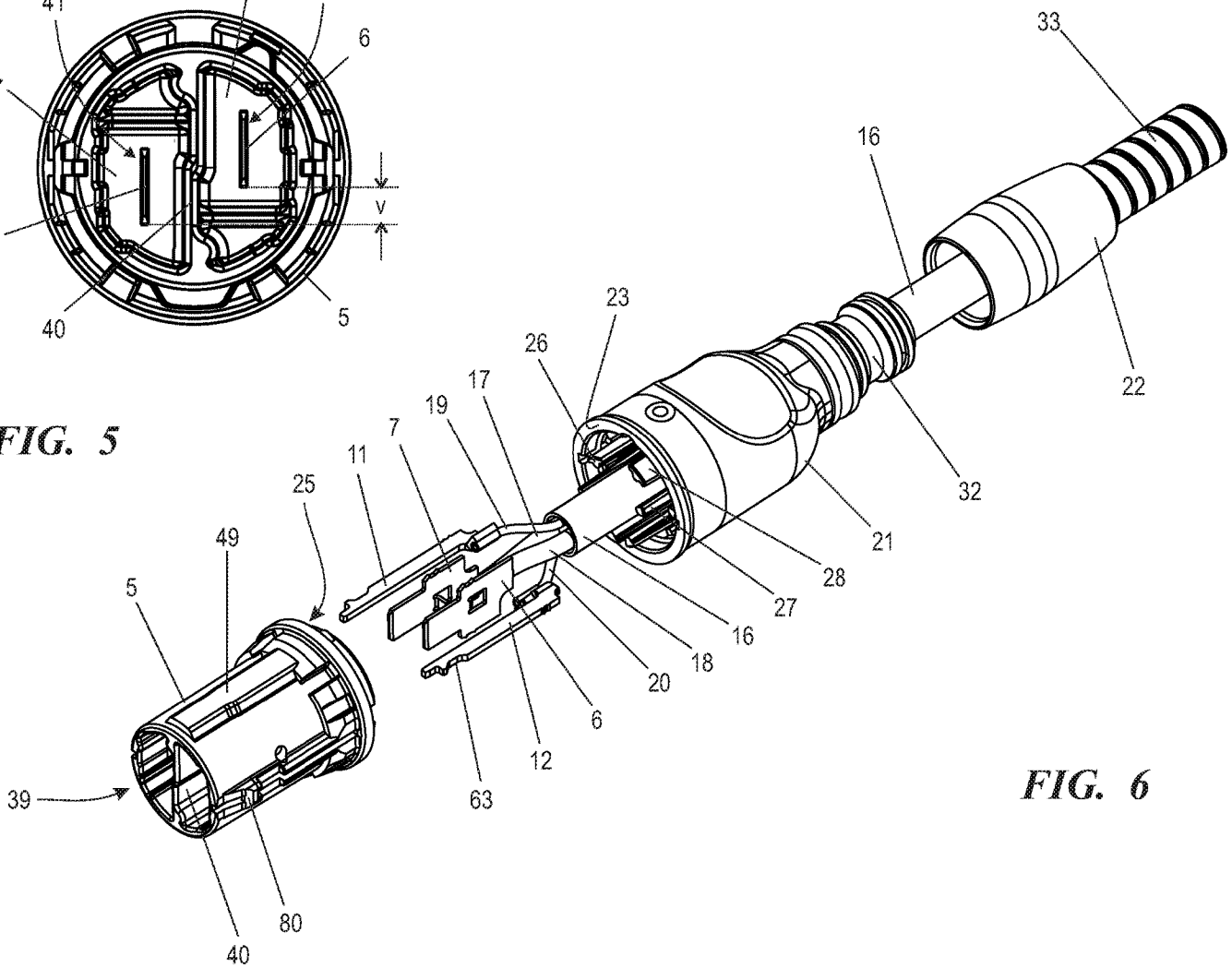
FIG. 5 shows an end view of the plug in accordance with arrow V in FIG. 4.
FIG. 6 is an exploded illustration of the plug into its individual parts.

The plug housing 21 is situated—as shown in FIG. 6—between the end sleeve 22 and the plug body 5. The electrical connection line 16 has two first lines 17, 18 for the purpose of transmitting power and two second lines 19, 20 for signal transmission operations. The second lines 19, 20 for the signal transmission operations are connected to the external contacts 11, 12; the first lines 17, 18 are connected to the plug contacts 6, 7.

Figure 7:
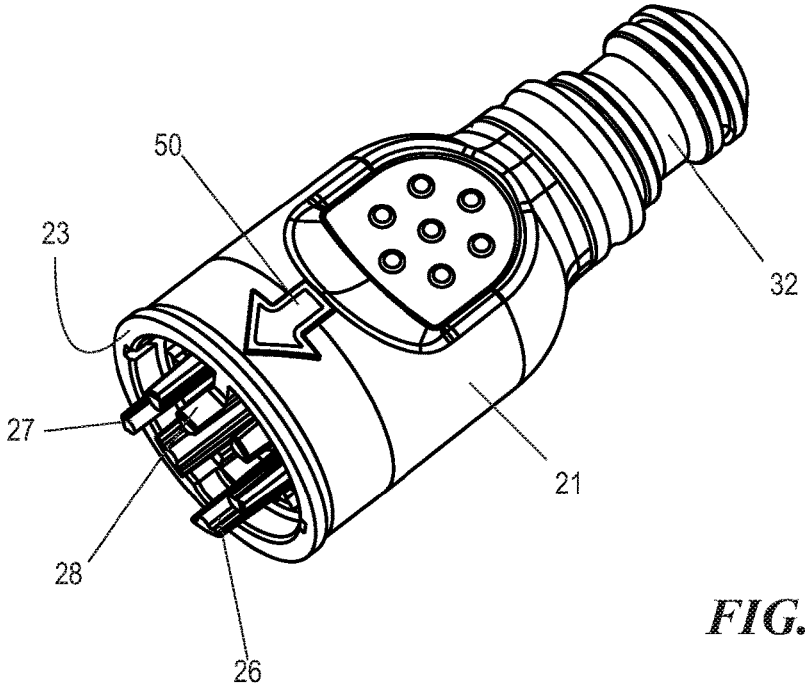
FIG. 7 is a perspective illustration of a plug housing.
Figure 8:
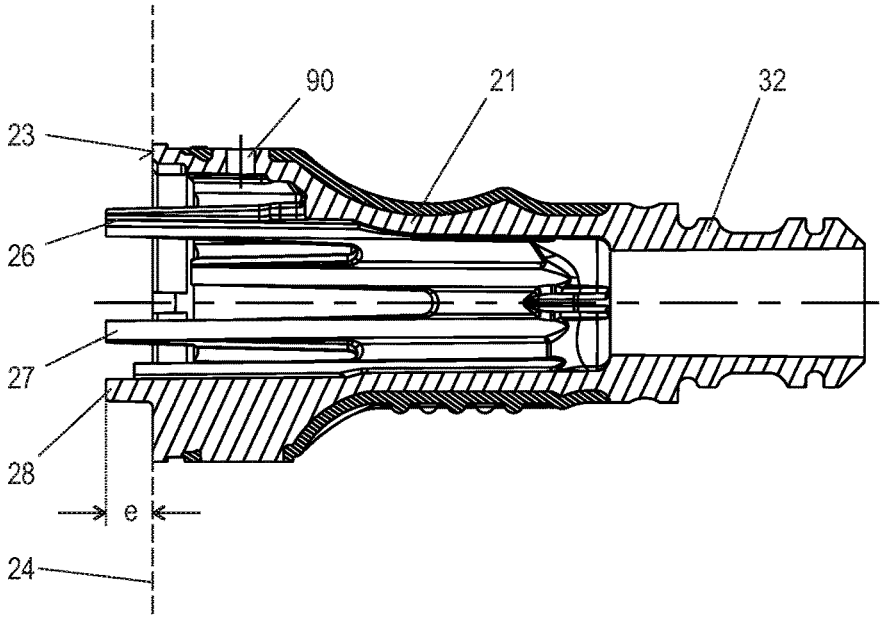
FIG. 8 shows a section through the plug housing according to FIG. 7.

The plug housing 21 has an end side 23 which faces the plug body and defines a separating plane 24 (FIG. 8) between the plug body 5 and the plug housing 21. The separating plane 24 is formed between a connection end 25 of the plug body 5 and the end side 23 of the plug housing 21. As shown in FIGS. 7 and 8 in particular, the plug housing 21 has coupling fingers 26, 27, 28 which pass through the separating plane 24. The coupling fingers 26, 27, 28 project beyond the separating plane 24 by way of a partial length e. It may be expedient for the connection end 25 of the plug body 5 to have, as an alternative or in addition, coupling fingers which pass through the separating plane 24. In the fitted position according to FIG. 9, the coupling fingers 26 protrude into the plug body 5. The hollow space 29 in the plug body 5 and the hollow space 30 in the plug housing 21 are filled with an injection-molding compound 31, in particular filled with an adhesive injection-molding compound 31, preferably after the plug body 5 has been fitted to the plug housing 21. To this end, an injection opening 90 (FIG. 8) can be provided in the plug housing 21. The plug body 5 is fixedly connected by way of its connection end 25 to the plug housing 21. The protruding end of the connection line 16 is also tightly connected to the plug 4 by the injection-molding compound 31.

The plug housing 21 has an insertion end 32 for the connection line 16. The connection line 16 is provided with a protective tube 33 for the purpose of forming a kink-prevention means. The connection line 16 runs through the protective tube 33 which is provided, in particular, as an articulated metal tube in the embodiment shown. That end 34 of the protective tube 33 which faces the plug housing 21 can be widened before fitting and the outside diameter A of the end can be expanded. In this way, the end 34 obtains an outside diameter A which is larger than an inside diameter I of an end sleeve 22. The protective tube 33 is held in an axially interlocking manner on the plug housing 21 via the end sleeve 22 which is fixed on the insertion end 32.

The end 34 of the protective tube 33 can also be widened in a different way. For example, a stopper—which is preferably provided in the end sleeve 22—can be pushed into the end 34 of the protective tube 33 in order to widen the outside diameter A of the end 34 and in this way fix the end in the end sleeve 22 in an axially interlocking manner—advantageously when fitting the end sleeve 22.

The end sleeve 22 is pushed axially over the insertion end 32, wherein a latching ring 35 which is in the form of a spring ring and latches the end sleeve 22 onto the insertion end 32 of the plug housing 21 in an interlocking manner acts between the insertion end 32 of the plug housing 21 and the receiving section 36. To this end, an external groove 37 is provided in the outer circumference of the insertion end 32 and an internal groove 38 is provided in the end sleeve 22.

As shown in the end view of the plug end 39 of the plug body 5, each plug contact 6, 7 is situated in an associated contact area 46, 47. The contact areas 46, 47 are separated from one another by a continuous separating wall 40. In the embodiment shown, the plug contacts 6, 7, which are in the form of flat contacts, are situated in planes which are parallel to one another; however, the plug contacts 6, 7 are displaced relative to one another by an offset v, as shown in FIG. 5. If more than two plug contacts are provided, different relative positions of the plug contacts in relation to one another may be expedient. If, for example, three plug contacts are provided, the plug contacts can lie in planes which in each case form an angle of, in particular, 120° in relation to one another.

Figure 11:
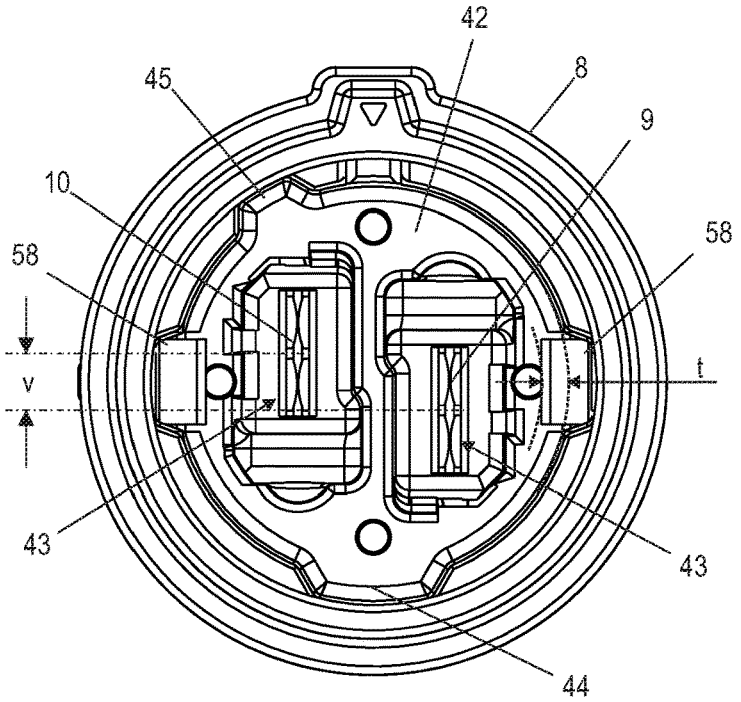
FIG. 11 shows an end view of a plug socket of the plug connection.
Figure 12:
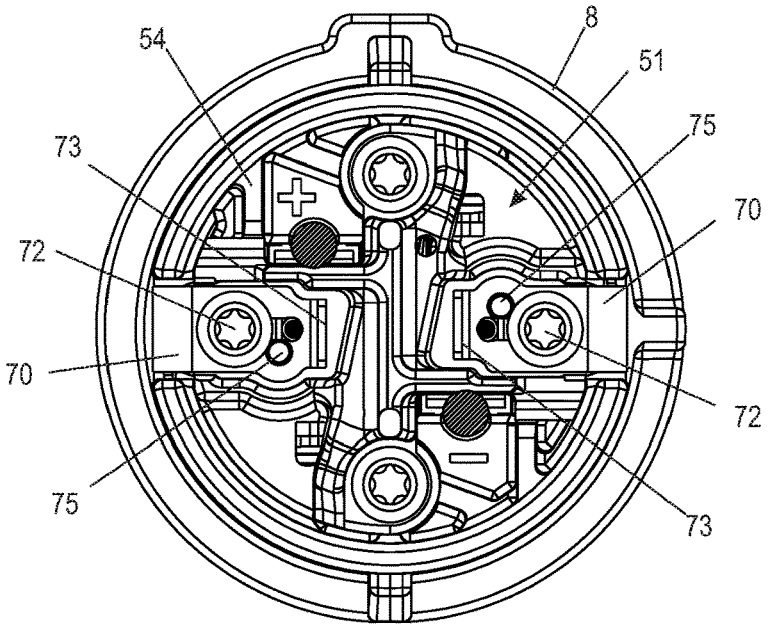
FIG. 12 shows a view of the connection side of a plug socket according to FIG. 11.
Figure 13:
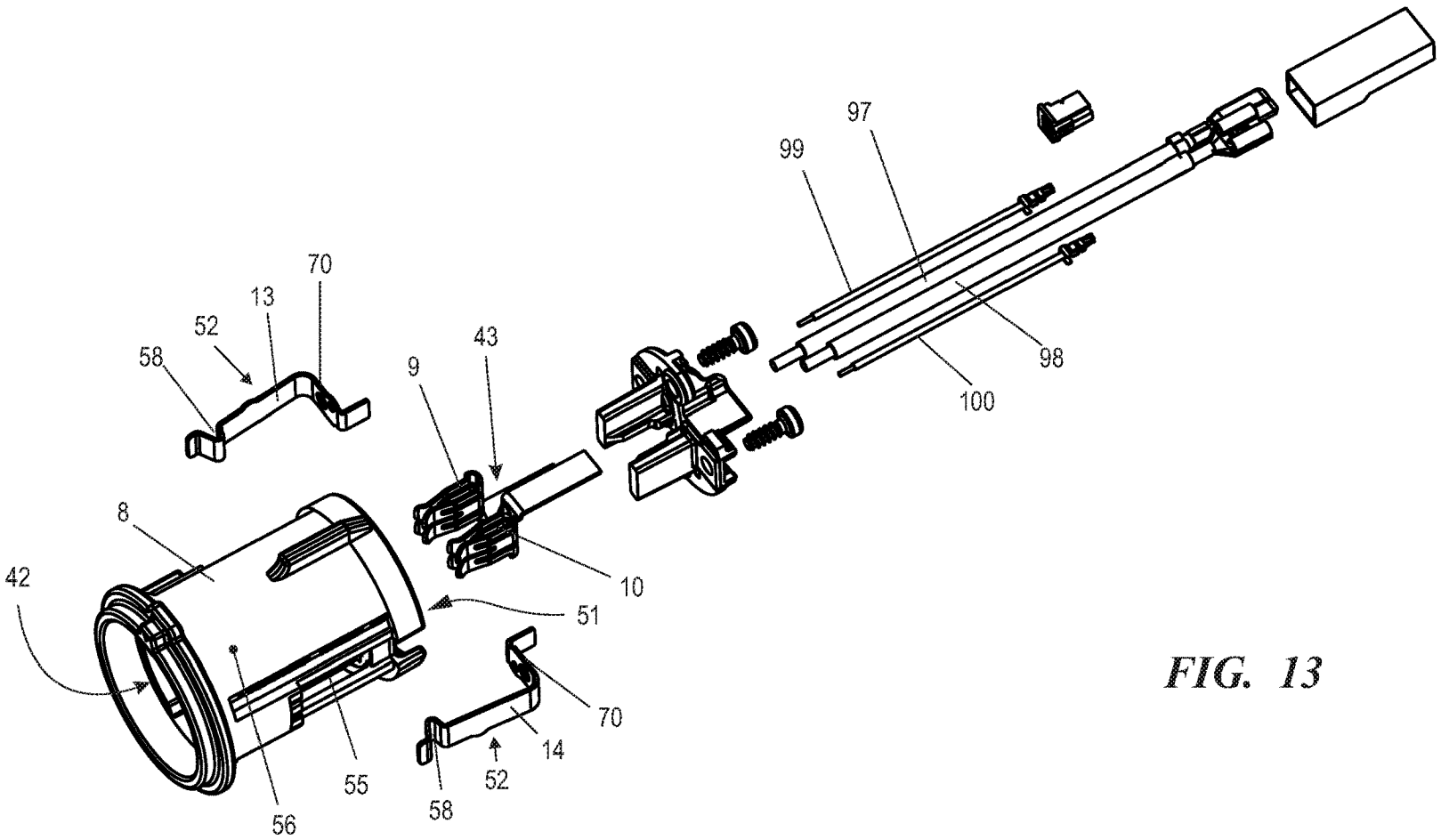
FIG. 13 is an exploded illustration of a plug socket of a plug connection according to the invention.

The configuration of the plug socket 8 is shown in FIGS. 11 to 13.

The plug socket 8 has a receiving space 42 in which the plug body 5 is received. The plug contacts 6, 7 engage in contact sockets 9, 10 which are in the form of contact terminals 43 for receiving the plug contacts 6, 7 which are in the form of contact tongues 41.

Two receiving grooves 44, 45 for positioning ribs 48, 49 (FIGS. 4, 6), which are provided on the plug body, are situated in an offset manner over the circumference of the plug socket 8. In the embodiment, the positioning ribs 48, 49 have a different width in the circumferential direction in accordance with the intended receiving grooves 44 and 45. The receiving grooves 44, 45 and the positioning ribs 48, 49 ensure insertion of the plug 4 in the insertion direction 50 into the plug socket 8 in the correct position.

Owing to the offset v of the contact sockets 9, 10 and, respectively, of the plug contacts 6, 7, enough space is created on the connection side 51, for example of the plug socket 8, in order to be able to use different connection techniques for connecting the electrical lines 17, 18, 19, 20. For example, FIG. 13 shows that the connection lines can be electrically connected on the connection side 51 (FIGS. 12, 13) of the contact socket 9 via screw contacts, solder contacts, crimp contacts, plug contacts or the like.

The contact sockets 9, 10 are situated in the base of the plug socket 8. The electrical lines 17, 18 are connected to the contact sockets 9, 10 and transmit the electrical power which is required for the purpose of operating the work apparatus 3.

Signal transmission between the work apparatus 3 and the rechargeable battery pack 2 is performed via the second lines 19, 20 which are in the form of signal lines. The signal lines are connected to mating contacts 13, 14. A mating contact 13, 14 of this kind is in the form of a spring tongue 52 and is fixed at an end 73 on the connection side 51 of the plug socket 8 to the base 54 of the plug socket. The leaf spring-like mating contact 13, 14 is situated in a receiving slot 55 of the plug socket 8 which is formed in a circumferential wall 56 of the plug socket 8. The circumferential wall 56 delimits a receiving space 42 for the plug body 5. The mating contact 13, 14 is situated radially outside the receiving space 42 and protrudes by way of a free contact end 58 with a protrusion t through the receiving slot 55 in the circumferential wall 56 into the receiving space. FIG. 11 shows the contact ends 58 of the mating contacts 13, 14, which contact ends protrude into the receiving space 42.

The external contacts 11, 12 (FIGS. 3, 4) interact with the mating contacts 13, 14, wherein, in addition to electrical contact being made between the external contact and the mating contact, a latching connection 15 is formed at the same time, as shown in FIG. 3.

The external contacts 11, 12 and the mating contacts 13, 14 are formed in accordance with FIGS. 14 to 17 for the purpose of forming a latching connection 15.

Figure 14:
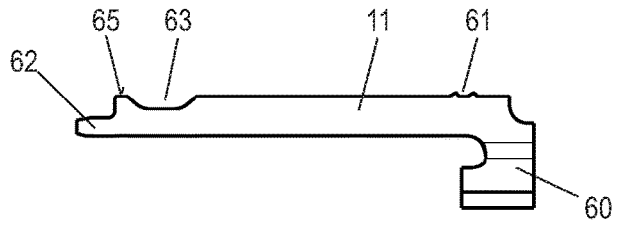
FIG. 14 shows a side view of an external contact which is provided on the plug body of the plug connection.
Figure 15:
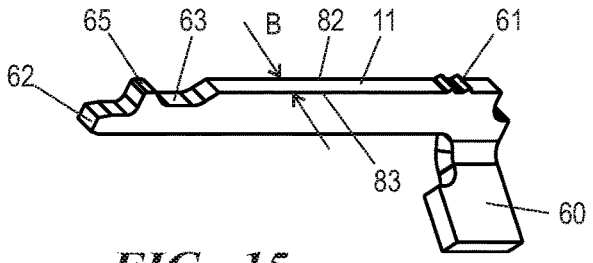
FIG. 15 shows a perspective view of the external contact according to FIG. 14.

FIGS. 14 and 15 show an external contact 11; the external contact 12 is formed in a corresponding manner.

Figure 9:
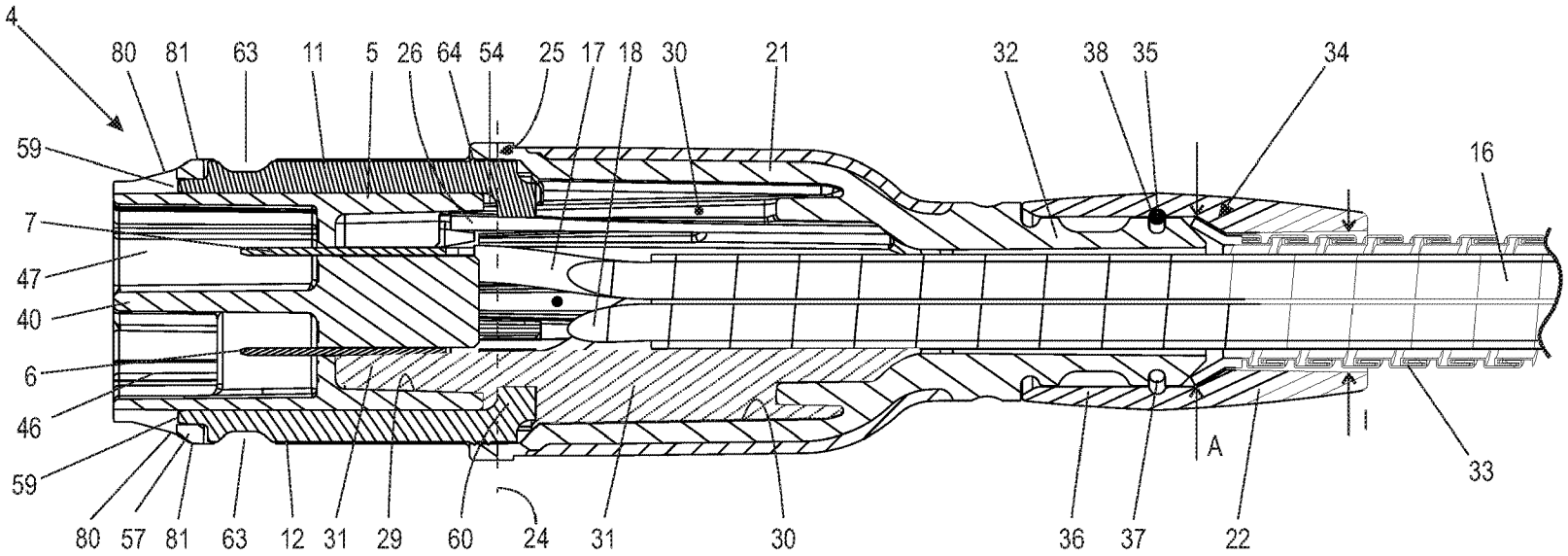
FIG. 9 shows a section through a plug which is fitted to a connection line.
Figure 10:
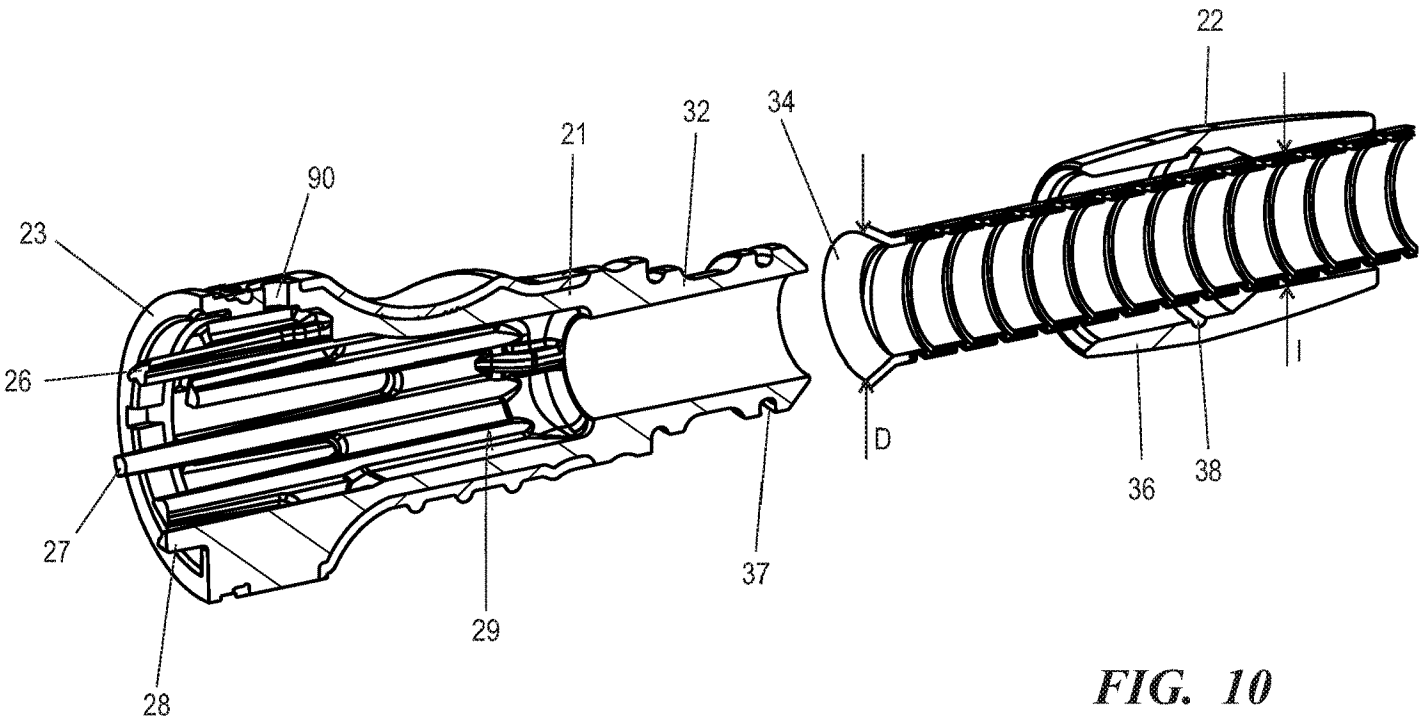
FIG. 10 is a schematic illustration of the connection of a protective metal tube to the plug housing.

Each external contact 11 has a fastening end 60 by way of which the external contact is fixed in the material 57 of the plug body 5. The fastening end 60 preferably has latching teeth 61 which advantageously establish a connection between the external contact 11, which is held in the plug body 5, and the plug housing 21. The other, free end of the external contact 11 forms a fixing lug 62 which engages into an opening 59 in the plug body 5, as shown in FIG. 9 for example. The external contact 11 has a latching recess 63 in the region of the fixing lug 62.

Figure 16:
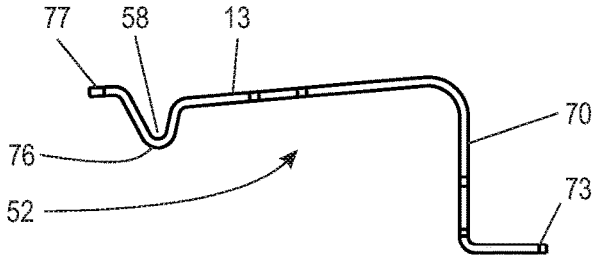
FIG. 16 shows a side view of a mating contact which is arranged on a plug socket of the plug connection.
Figure 17:
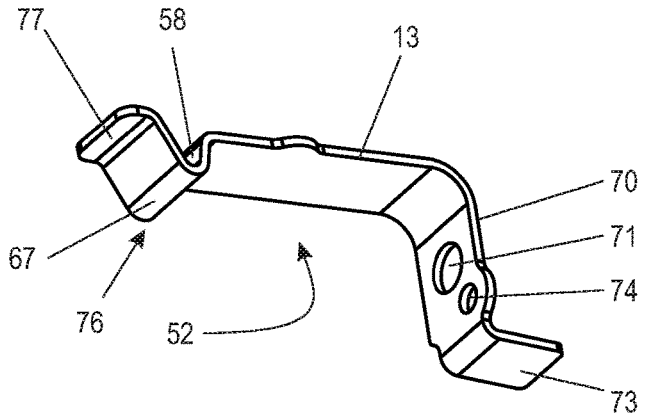
FIG. 17 is a perspective illustration of the mating contact according to FIG. 16.

FIGS. 16 and 17 show the configuration of a mating contact using the example of mating contact 13. The mating contact 14 corresponds to the configuration of the mating contact 13.

The mating contact has the approximate shape of an L with angled limb ends in side view. The first limb 70 of the mating contact 13 has—as shown in FIG. 17—a fastening opening 71 for engagement of a fastening screw 72, as shown in FIG. 12. The mating contact is mechanically fixed to the base 54 of the plug socket 8 via the limb 70.

The angled end 73 of the limb 70 is upright for the purpose of mounting a cable shoe. Furthermore, a further passage hole 74 is provided in the limb 70, a centering pin 75 of the base 54 of the plug socket 8 engaging into the further passage hole.

The contact end 58 is formed at the free end of the mating contact 13. The contact end 58 has an approximate V-shape in side view, as shown in FIG. 16. The contact end 58 has a rounded contact region 76, wherein the contact end 58 ends in a stop tongue 77. A housing stop 78 on the circumferential wall 56 of the contact socket 8 is associated with the stop tongue 77, as shown, in particular, in the enlarged illustrations of FIGS. 18 and 19.

The stop tongue 77 delimits, together with the housing stop 78, the protrusion t (FIG. 11) of the contact end 58 into the receiving space 42 of the plug socket 8, the protrusion being possible in the inoperative state.

Figure 18:
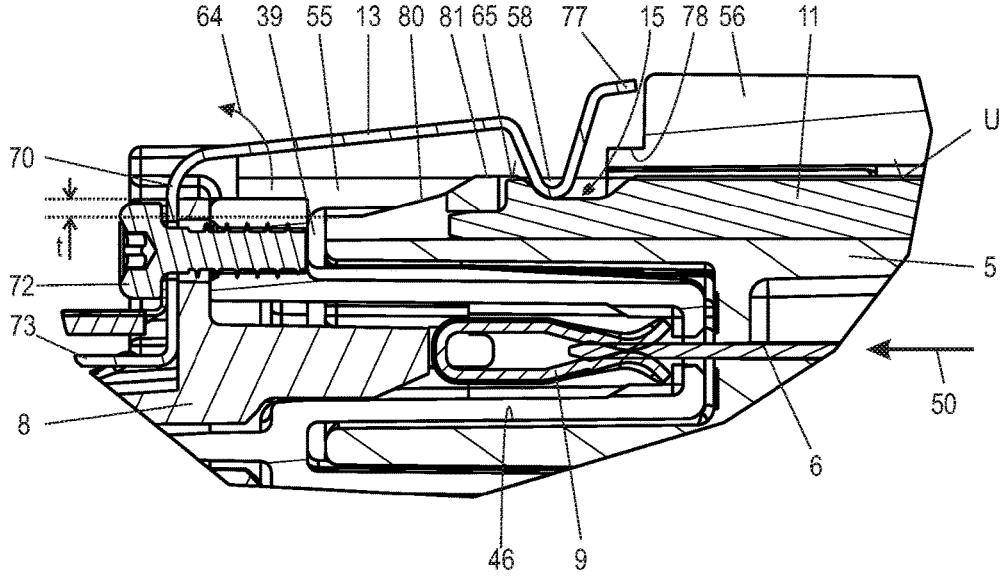
FIG. 18 is an enlarged illustration of a detail of the latching connection between the plug and the plug socket of the plug connection.
Figure 19:
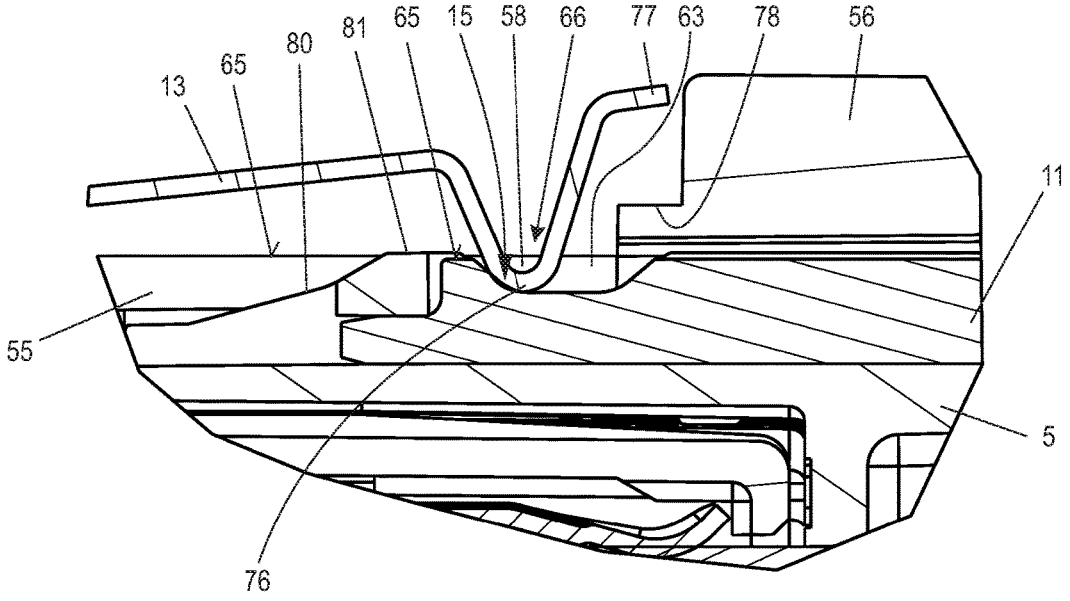
FIG. 19 is an enlarged illustration of the latching connection between the plug body and the plug socket of the plug connection.

As shown in FIGS. 18 and 19, there is a ramp 80 in front of the latching recess 63 in the external contact 11 or 12 in the insertion direction 50 of the plug body 5 into the receiving socket 8. The ramp 80 begins at a height which corresponds approximately to the protrusion t of the contact end 58 into the receiving space 42 when the plug 4 is withdrawn. The ramp 80 rises to a height 81 which corresponds approximately to the outer circumference U of the plug body 5. The height 81 is level with a top edge 65 of the latching recess 63 (FIGS. 14, 15).

When the plug 4 is inserted in insertion direction 50, the plug end 39 axially enters the receiving space 42 of the plug socket 8—assuming the plug body 5 is correctly associated with the plug socket 8 in respect of rotation position. The plug end 39 engages beneath the contact end 58, with the result that the contact end can slide onto the ramp 80 and is driven radially outward in arrow direction 64 against a spring force. If the highest elevation of the ramp 80 is reached at the height 81, the rounded contact region 76 of the contact end 58 slides on the outer circumference U of the plug body 5, until the contact end 58 engages into the latching recess 63. The contact end 58 which is situated in the latching recess 63 establishes an electrical connection between the external contact 11 and the mating contact 13 via the contact region 76. The plug is mechanically locked in the plug socket 8 at the same time. The contact end 58 therefore forms a latching lug 66, which engages into the latching recess 63, at the same time.

The plug connection not only establishes a connection between power-transmitting first lines 17, 18, but at the same time a signal connection via two electrical lines 19, 20, in a reliable manner. In the process, the outside diameter of the plug connection can be kept small on account of the arrangement of the contacts.

Figure 20:
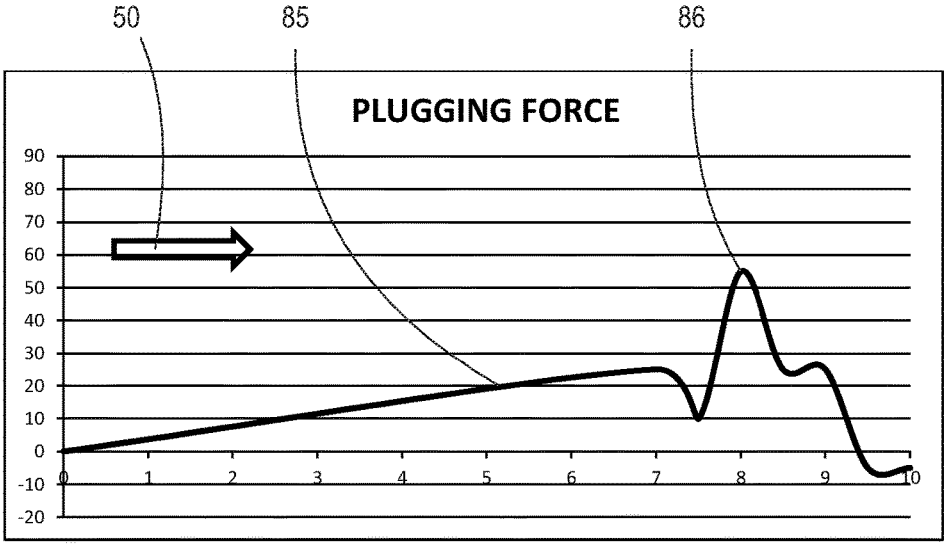
FIG. 20 shows a schematic curve of the force profile when the plug connection is made.

Furthermore, the invention ensures that the plug is secured in the plug socket 8 in a mechanically fixed manner. The user has to overcome a latching force both when inserting the plug 4 into the plug socket 8 and also when withdrawing the plug 4 from the plug socket 8. By way of example, FIG. 20 shows the force profile, which has to be exerted by the user, in accordance with curve 85. When the plug 4 is inserted into the plug socket 8, the plugging force which has to be applied by the user increases moderately in accordance with curve 85 until the latching lug 66 meets the ramp 80. The insertion force increases to a maximum 86 at which the latching lug 66 has slid onto the maximum height 81 of the ramp 80. The latching lug 66 now engages into the latching recess 63, wherein the force which has to be applied by the user drops sharply to zero. The process of overcoming the maximum 86 of the force profile in accordance with curve 85 provides the user with haptic feedback that the plug 4 is correctly inserted into the plug socket 8.

Figure 21:
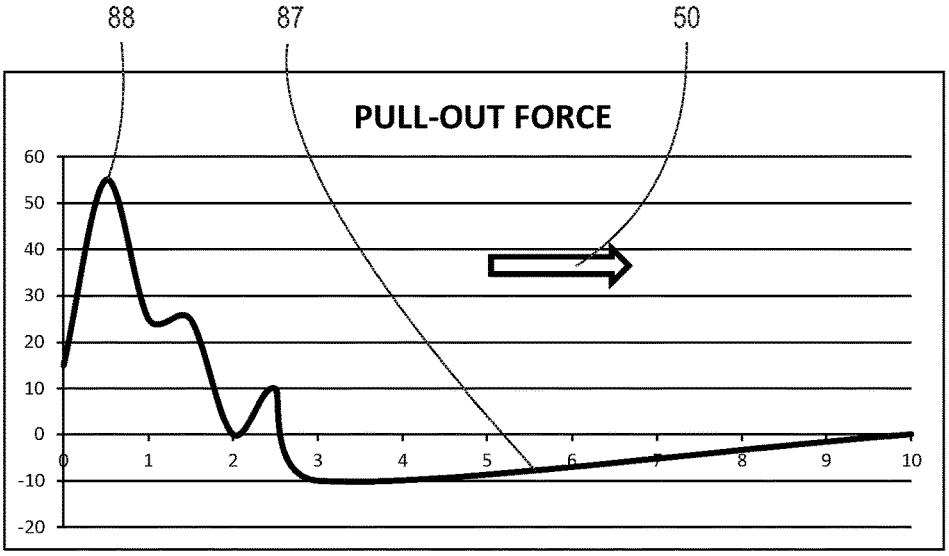
FIG. 21 is a schematic illustration of the force profile when the plug connection is released.

A significant force profile in accordance with curve 87 in FIG. 21 is also produced when unplugging the plug 4. If the user pulls the plug 4, he has to apply a maximum amount 88 of force as early as after a short distance before the plug 4 is released from the plug socket 8. After the maximum 88 has been overcome, the force drops significantly, with the result that the user receives haptic feedback about the plug connection 1 being released.

The fluctuations in the force profile of the curves 85, 87 shown in FIGS. 20 and 21 are caused by superimposition of the forces occurring when inserting and, respectively, releasing the plug connection 1 by the plug contacts 6, 7 and contact sockets 9, 10 for the purpose of transmitting the electrical power and the external contacts 11, 12 and mating contacts 13, 14 for the purpose of signal transmission which are formed differently thereto.

The significant drop in force in curve 85, shown in FIG. 20, after the maximum 86, in particular to a negative force in the scale range of the x-axis between 9 and 10, is caused by the latching lug 66 being drawn into the latching recess 63. This structural configuration and the resulting force profile ensure that the plug 4 necessarily always reaches an end position; stable intermediate positions are not possible. The negative force profile of the curve 87 after the maximum 88, which negative force profile occurs when the plug connection 1 is disconnected, is the result of the ramp 80 on the plug body 5. The maximum 88 is determined by the latching lug 66 lifting out of the latching recess 63.

Figure 22:
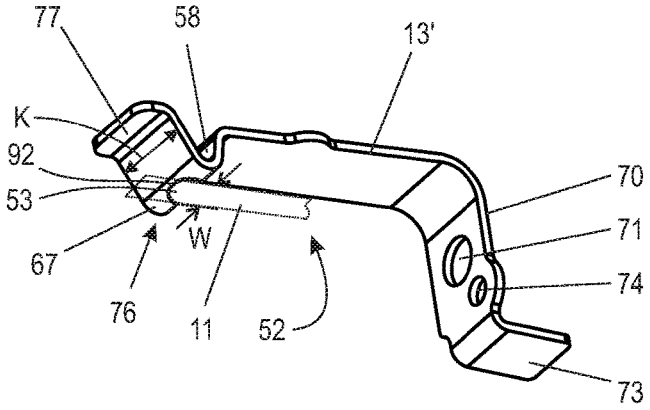
FIG. 22 is a perspective illustration of the mating contact in accordance with FIG. 17 with an opening which is formed in the contact region.

FIG. 22 shows a perspective illustration of a mating contact 13', as is also illustrated in FIG. 17. Identical parts are provided with the same reference symbols.

In contrast to the configuration of the mating contact 13 in accordance with FIG. 17, the mating contact 13' in FIG. 22 has an opening 53 in the contact region 76. The opening 53 has an opening width W which extends in width direction K of the contact region 76 and is expediently equal to or advantageously greater than the width B (FIGS. 15, 24) of the external contact 11. The opening width W of the opening 53 is smaller than the maximum width M (FIG. 24) of the contact region 76. The maximum width M of the contact region 76 is measured in width direction K.

The opening 53 can have a round shape. Geometries which differ from the circular shape can advantageously be provided too. A circular shape, an elliptical shape, a square shape or a rectangular shape are preferred. In the case of an ellipse or a rectangle, the larger geometry axis extends in width direction K of the contact region 76.

Figure 23:
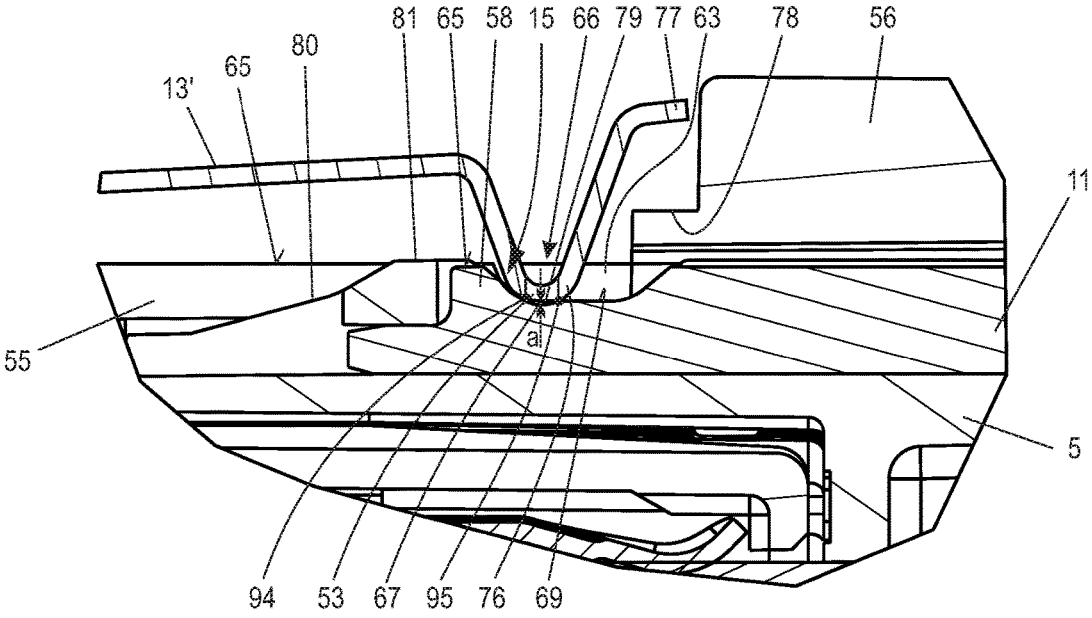
FIG. 23 is an enlarged illustration of the latching connection between the plug body and the plug socket of the plug connection with a mating contact according to FIG. 22; and, FIG. 24 is a schematic illustration of the contact connection between an external contact and a mating contact of the plug connection.

The function of the opening 53 can be identified in the enlarged illustration of the latching connection 15 between the plug body 5 and the plug socket of the plug connection 1 according to FIG. 23. The illustration in FIG. 23 corresponds to that in FIG. 19; the same reference symbols are used for identical parts.

Owing to the opening 53 in the contact region 76, the external contact 11 of the plug body 5, which external contact is particularly in the form of a plug tongue, is situated in the opening area 79 of the opening 53. The highest elevation 67 of the contact region 76 is situated higher than the opening area 79 of the opening 53. The highest elevation 67 of the contact region 76, which highest elevation is situated outside the opening 53, is situated, in the contacted position according to FIG. 23, below the base 69 of the latching recess 63, as shown in FIG. 23. The opening area 79 of the opening 53 is situated at a vertical distance a lower than the highest elevation 67.

Figure 24:
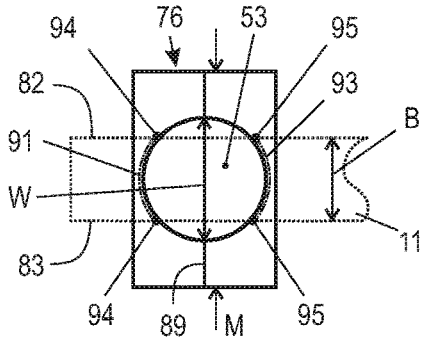

The opening 53 in the contact region 76 of the mating contact 13, which is particularly in the form of a contact spring, can, at least by way of a subregion of its opening edge 92, come to bear so as to make contact on the base 69 of the latching recess 63. This is schematically illustrated in FIG. 24.

In a simple embodiment, at least the longitudinal edges 82 and 83 (FIGS. 15, 24) of the external contact 11 come to bear against the opening edge 92 so as to make contact. The bearing points 94 and 95 which make contact and are produced owing to the longitudinal edges 82 and 83 bearing against the opening edge 92 are illustrated in FIG. 24. At least one bearing point 94 or 95 is produced on at least one longitudinal edge 82 or 83 on account of the opening 53. In particular, at least one bearing point 94 or 95 can be produced on one or the other longitudinal edge 82 and 83. In a particular embodiment of the invention, in each case two bearing points 94 and 95 are produced on each longitudinal edge 82 and 83, as a result of which electrical contact is made between the external contact 11 and the mating contact 13 by a total of four contact-making bearing points which ensure reliable signal transmission.

It may be advantageous to form the opening 53 in such a way that the opening edge 92 rests by way of two edge sections 91 and 93 on the base 69 of the latching recess 63 of the external contact 11 so as to make electrical contact. This is illustrated using dashed lines in FIG. 24. A first, front edge section 91 extends between the front bearing points 94 of the longitudinal edges 82, 83. A second, rear edge section 93 extends between the rear bearing points 95 of the longitudinal edges 82, 83. The contact-making edge sections 91 and 93 can also rest on the base 69 of the latching recess 63 so as to make only partial contact. The edge sections 91 and 93 advantageously rest on the base 69 of the latching recess 63 so as to make electrical contact over the entire subsection of the opening edge 92.

The opening 53 is preferably situated centrally in the contact region 76 of the mating contact 13. As shown in the schematic plan view according to FIG. 24, the opening 53 is expediently situated symmetrically in relation to the highest elevation 67, in particular symmetrically in relation to the vertical line 89 of the highest elevation 67.

Further advantageous embodiments are produced by any desired combination of the features of the above-described embodiments.

It is understood that the foregoing description is that of the preferred embodiments of the invention and that various changes and modifications may be made thereto without departing from the spirit and scope of the invention as defined in the appended claims.

What is claimed is:

1. An electrical plug connection for releasable electrical connection of a power source to an electric work apparatus, the electrical plug connection comprising:

a first electrical line configured to transmit electrical power;

at least one second electrical line configured to transmit signals;

a plug including a plug body having an outer contour;

a first plug contact;

a plug socket having a first contact socket;

said first plug contact being associated with said first electrical line configured to transmit electrical power and being arranged within said plug body;

said second electrical line configured to transmit signals having a second plug contact;

said second plug contact being configured as an external contact in the region of said outer contour;

said external contact being configured to transmit signals;

said plug socket having a mating contact configured to transmit signals associated with said external contact of said plug body;

said mating contact configured to transmit signals and said external contact configured to transmit signals being configured to form a latching connection;

said mating contact configured to transmit signals having a mating contact end; and, a latching lug being formed by said mating contact end.

2. The plug connection of claim 1, wherein:

said plug body defines an outer periphery; and, said external contact configured to transmit signals is arranged on said outer periphery of said plug body.

3. The plug connection of claim 1, wherein said mating contact configured to transmit signals is configured as a spring tongue.

4. The plug connection of claim 1, wherein:

said external contact configured to transmit signals includes a latching recess; and, said mating contact configured to transmit signals has said latching lug associated with said latching recess.

5. The plug connection of claim 1, wherein, in an insertion direction of said plug body, a ramp is formed on said plug ahead of said external contact configured to transmit signals.

6. The plug connection of claim 1 further comprising:

a plug housing; and, said plug body having a plug body end facing said plug socket and a connection end held on said plug housing.

7. The plug connection of claim 6, wherein:

the plug connection defines a separating plane between said connection end and said plug housing;

at least one of said connection end and said plug housing has coupling fingers; and, said coupling fingers protrude through the separating plane.

8. The plug connection of claim 6, wherein said plug body and said plug housing are interconnected via an injection molding compound.

9. The plug connection of claim 1, wherein:

said plug socket includes a peripheral wall defining a receiving slot;

said peripheral wall delimits a receiving space;

said mating contact configured to transmit signals is disposed radially outside said peripheral wall; and, said mating contact configured to transmit signals has a free contact end which projects through said receiving slot into said receiving space.

10. The plug connection of claim 1, wherein, in a frontal view onto said plug body, said plug contacts of said first electrical line configured to transmit electrical power are disposed mutually offset at a distance (v) from each other.

11. The plug connection of claim 1, wherein:

said first plug contact and said first contact socket are configured to transmit electrical power;

said first contact socket is configured as a contact terminal; and, said first plug contact is configured as a plug tongue configured to contact with said contact terminal.

12. The plug connection of claim 1, wherein:

said mating contact configured to transmit signals of said plug socket includes a contact area for electrically contacting said external contact configured to transmit signals; and, said contact area defines an opening.

13. The plug connection of claim 12, wherein:

said contact area includes a highest elevation and is configured to transmit signals; and, said opening defines an opening surface disposed at a vertical distance (a) below said highest elevation.

14. The plug connection of claim 12, wherein:

said opening has an opening width (W);

said external contact configured to transmit signals has a width (B); and, said opening width (W) is wider than said width (B).

15. The plug connection of claim 12, wherein:

said opening defines an opening edge;

said external contact configured to transmit signals includes two longitudinal edges; and, said longitudinal edges contact said opening edge in an electrically contacting manner in at least one contact point.

16. The plug connection of claim 12, wherein said opening defines an opening edge having an edge section which contacts said external contact configured to transmit signals in an electrically contacting manner.

17. An electrical plug connection for releasable electrical connection of a power source to an electric work apparatus, the electrical plug connection comprising:

a first electrical line configured to transmit electrical power;

at least one second electrical line configured to transmit signals;

a plug including a plug body having an outer contour;

a first plug contact;

a plug socket having a first contact socket;

said first plug contact being associated with said first electrical line and being arranged within said plug body;

said second electrical line having a second plug contact;

said second plug contact being configured as an external contact in the region of said outer contour said plug socket having a mating contact associated with said external contact of said plug body;

said mating contact and said external contact being configured to form a latching connection;

said plug socket including a peripheral wall defining a receiving slot;

said peripheral wall delimiting a receiving space;

said mating contact being disposed radially outside said peripheral wall;

said mating contact having a free contact end which projects through said receiving slot into said receiving space;

said free contact end having a protrusion (t) projecting into said receiving space; and, said free contact end having a stop tongue which delimits said protrusion (t).

* * * * *